United States Patent [19]

Igarashi

[11] Patent Number: 5,058,895

[45] Date of Patent: Oct. 22, 1991

[54] GOLF CLUB WITH IMPROVED MOMENT OF INERTIA

[76] Inventor: Lawrence Y. Igarashi, 25532 Rapid Falls Rd., Laguna Hills, Calif. 92653

[21] Appl. No.: 402,061

[22] Filed: Sep. 1, 1989

Related U.S. Application Data

[63] Continuation-in-part of Ser. No. 301,634, Jan. 25, 1989, abandoned.

[51] Int. Cl.[5] ..... A63B 53/04

[52] U.S. Cl. ..... 273/167 F; 273/169; 273/171; 273/80 A

[58] Field of Search ..... 273/167 R, 167 F, 167 H, 273/169-172, 167 A, 80 A, 173, 174, 78, 77 R

[56] References Cited

U.S. PATENT DOCUMENTS

| | | | |
|---|---|---|---|
| 739,458 | 9/1903 | Travis | 273/169 |
| 942,353 | 12/1909 | Rigden | 273/169 |
| 1,049,266 | 12/1912 | Rivers | 273/174 X |
| 1,133,129 | 3/1915 | Govan | 273/171 |
| 1,538,312 | 5/1925 | Beat | 273/171 |
| 2,056,335 | 10/1936 | Wettlaufer | 273/173 X |
| 2,954,231 | 9/1960 | MacIntyre | 273/169 X |
| 3,374,027 | 3/1968 | Jacobs | 273/162 E X |
| 3,652,094 | 3/1972 | Glover | 273/171 |
| 3,888,492 | 6/1975 | Cabot | 273/173 X |
| 4,553,755 | 11/1985 | Yamada | 273/171 |
| 4,681,321 | 7/1987 | Chen et al. | 273/169 X |
| 4,867,458 | 9/1989 | Sumikawa et al. | 273/171 |
| 4,869,507 | 9/1989 | Sahm | 273/171 |

FOREIGN PATENT DOCUMENTS

| | | | |
|---|---|---|---|
| 211781 | 12/1957 | Australia | 273/169 |
| 160030 | 3/1921 | United Kingdom | 273/167 F |
| 440379 | 12/1935 | United Kingdom | 273/171 |
| 455748 | 10/1936 | United Kingdom | 273/169 |
| 2126906 | 4/1984 | United Kingdom | 273/175 |

OTHER PUBLICATIONS

"Toski-Metal Woods", as seen in *Ohio Golf Magazine,* May 1989, p. T7.

"Straighter Shots from Curved Clubfaces", as seen in *Golf Digest,* Jul. 1965, pp. 70-75.

*Primary Examiner*—Edward M. Coven

*Assistant Examiner*—Sebastiano Passaniti

*Attorney, Agent, or Firm*—Roberts and Quiogue

[57] ABSTRACT

The specification herein discloses a golf club having an improved moment of inertia. The improved moment of inertia is for both a driver and a putter. The driver is formed of an investment casting having peripheral weights proximate the toe side and heel side of the club. A third weight is provided at the rear of the club. The weights provide a three dimensional configuration for weighting the club wherein the rear weight provides an increased moment of inertia. By increasing the moment of inertia, the club has a lesser tendency to twist when it strikes the ball off the center of gravity thereby creating less torque or twist to the club head for more accurate direction. The putter has the moment of inertia weighting applied above its midline center of gravity so that it provides overspin or top spin to the ball when struck.

5 Claims, 3 Drawing Sheets

GOLF CLUB WITH IMPROVED MOMENT OF INERTIA

This application is a Continuation in Part of U.S. patent application Ser. No. 301,634, filed Jan. 25, 1989, naming LAWRENCE Y. IGARASHI as sole inventor, entitled Golf Club with Improved Movement of Inertia, now abandoned.

FIELD OF THE INVENTION

The field of this invention lies within the golf club art. More particularly, it lies within the improved golf club art pertaining to causing a golf club to swing on an improved line after it strikes the ball. It relates to improving the moment of inertia of a club which was an object of many efforts of the prior art.

The prior art of golf clubs is such wherein various attempts have been made to improve the impact between a golf club and the golf ball. Such improvements have related in part to efforts to create a larger moment of inertia. The moment of inertia has been improved by such advances as metal woods or woods made of metal.

It has been recently suggested that perimeter weighting of clubs is an ideal. In order to establish perimeter weighting of clubs oftentimes drivers as well as woods are improved by removing the mass from the center of the club toward the heel and the toe, an improved moment of inertia is provided. However, in all of these cases, the improved moment of inertia has not effectuated an end result which could be eminently enhanced by the invention hereof which has not been seen in the prior art to date. An inventive application of physics to golf can lead to longer drives, greater directional accuracy and lower scores.

It has been found that when dealing with golf clubs, the moment of inertia is quite important. Inertia is the physical property which describes the tendency for an object to resist change. The moment of inertia is a measure of the tendency of an object to resist rotational or twisting changes. For directional accuracy in a golf club, a high moment of inertia is desired. This aids in reducing the twisting change in the club when the ball is struck.

A ball which hits the club face slightly off the center of gravity line will transmit forces and torques to the club. These forces and torques result in a slight twisting of the club which causes less control of directional accuracy. In effect the face of the club opens or closes depending upon whether it is hit respectively toward the toe or the heel.

An increased moment of inertia increases reproduceable directional accuracy.

Modern perimeter weighting has increased the moment of inertia in a two dimensional design. However, it is believed that nothing to date has increased the moment of inertia in a three dimensional orientation, except in a minor manner by virtue of metal woods as opposed to persimmon woods. The three dimensional design for enhanced moment of inertia as generally set forth by this invention, can increase the directional accuracy to a substantial degree.

Another improvement through improving the moment of inertia is to enhance the coefficient of restitution. Increased driving distances can be obtained by more efficient transfer of club energy to the golf ball. When the club strikes the ball, energy can be lost by torsional motion of the club when it is off-center. The coefficient of restitution is the quantitative physics term expressing how efficiently the club energy is transferred to the ball.

A club which has been designed to increase the moment of inertia through use of three dimensional weighting also will benefit in accuracy through an improved toothed rack effect. A toothed rack effect is a term of art which relates to how the club head face engages the ball and causes the ball to turn in the manner of one toothed rack (the club face) turning against another toothed rack (the ball) which has sometimes been referred to as a gear effect. The three dimensional weighting will move the center of gravity further back away from the club face relative to perimeter weighting. Moving the center of gravity further back from the face gives improved turning effect, which causes the ball trajectory to be truer to a straight line, that is, less drive to the left or right, which also can be called less hook or slice in the vernacular of golf.

Based upon the foregoing theories with respect to golf clubs and the analysis of the problem, it is believed that this invention sets forth a substantial improvement for providing increased moment of inertia and attendantly improved directional lines after a ball is impacted. The improvements hereof will be substantially seen as set forth in the following specification and attendant claims as those improvements become apparent over the prior art.

SUMMARY OF THE INVENTION

In summation, this invention provides an improved moment of inertia for a golf club.

An improved moment of inertia for a golf club tends to reduce the twisting change in the club when the ball is struck. When the ball is struck by the club of this invention, the decreased twisting due to the increased moment of inertia results in a greater directional control for the golfer.

Improvement is provided by obtaining a peripheral weighting of the club by means of weights toward the heel and the toe of the club. These weights substantially enhance the moment of inertia within a two dimensional field generally within the framework of the face of the club. This invention enhances and increases the moment of inertia by crating a three dimensional weighting effort. This three dimensional weighting effort is provided by a third weighted area within the back of the club or toward the back of the club. This third w weighted area is such wherein it provides for a weighting in a three dimensional manner by creating a third weighted area outside of the two dimensional weighted areas.

This third weighted area thereby creates a three dimensional weighting rather than a two dimensional weighting for an improved moment of inertia. The net result is when a ball is not struck on a line passing through the club head's center of gravity, it twists to a lesser degree than in clubs having no weighting or only two dimensional weighting. The result due to the limitation of twisting of the club causes the ball to travel with less loss of directional control.

The toothed rack turning effect of the club on the ball is enhanced by use of three dimensional weighting to improve the moment of inertia. This three dimensional weighting causes the center of gravity to be moved further back from the face of the club than for clubs designed with only perimeter weighting. The instantaneous center of rotation of the club head at time of impact with the ball will be found to be behind the center of gravity relative to the club face. That is to say, the distance from the club face to the center of gravity will be found to be less than the distance from the club face to the instantaneous center of rotation of the club head at time to impact. The ball and club head act in the fashion of engaging toothed racks during the time of ball and club contact. The side spin imparted to the ball by the club leads to hook or slice through the reaction of the spinning ball with the air during flight. Since the effective size of the toothed rack represented by the club is increased if the instantaneous center of rotation is moved further back in the club, then the toothed rack or turning effect on side spin will lead to less hook or slice on the ball. This is a direct effect of using three dimensional weighting rather than perimeter weighting to increase the moment of inertia in the club.

Consequently, this club summarily is a substantial improvement over the prior art by virtue of its improved lines of direction when a ball is struck off the center of gravity.

DESCRIPTION OF THE DRAWINGS

The invention will be more clearly understood by reference to the description below taken in conjunction with the accompanying drawings wherein.

THE PREFERRED EMBODIMENTS

Figure 1:
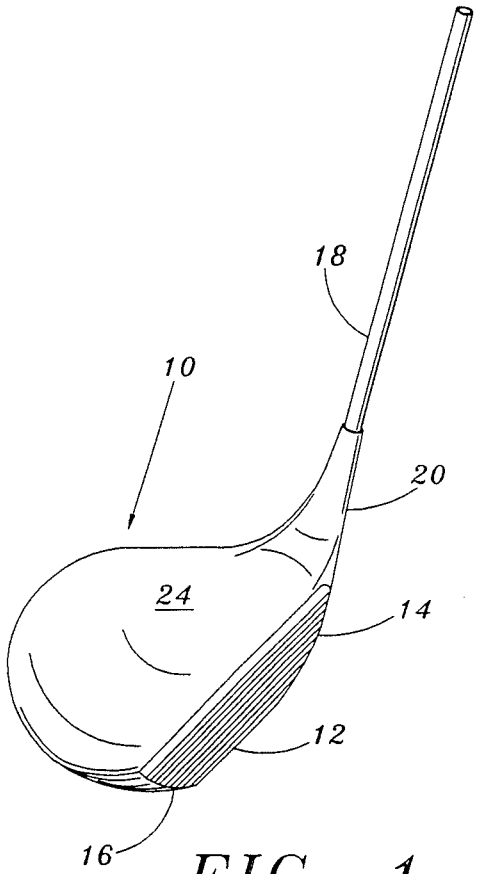
FIG. 1 shows a perspective view of a driving club of this invention.

Looking more specifically at FIG. 1, it can be seen that a golf club head 10 has been shown. The golf club head 10 has a face 12, a heel portion 14, and a toe portion 16. Connected to the club is a shaft 18. The shaft is connected by means of a hosel 20 having an opening therein which receives the club shaft 18. The club shaft 18 can be of any particular configuration so long as it provides for the proper swing and maintenance of the head moving in a proper direction through the ball. Shafts are known of various structures, including both reinforced composites and steel and other metal type shafts.

The club head is formed with a hollow cavity 22. The hollow cavity 22 is formed by means of an investment casting which specifically creates a rounded top 24 to the head, as well as the face 12 and rear 26 of the club 26. The rear 26 is not seen in the showing of FIG. 1 inasmuch as it curves around and is undercut. This rear surface 26 can be seen more effectively in FIG. 2 wherein it is formed by means of a curved angular portion, which is angularly cut with respect to the face 12 as seen more clearly in FIG. 4.

The cavity of the club, namely cavity 22 is formed by investment casting.

Figure 2:
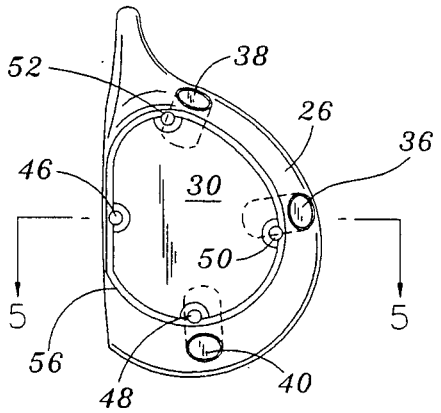
FIG. 2 shows a bottom plan view of the club of this invention with three weighted areas providing a three dimensional weighting configuration for improved moment of inertia.
Figure 4:
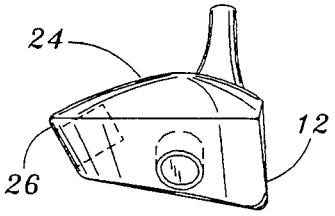
FIG. 4 shows an end view of the club looking from the toe of the club.
Figure 3:
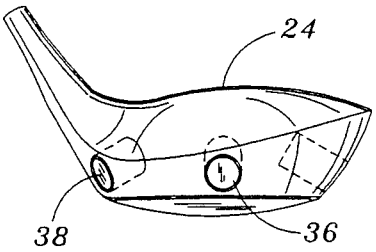
FIG. 3 shows a view of the back or rear of the club.
Figure 5:
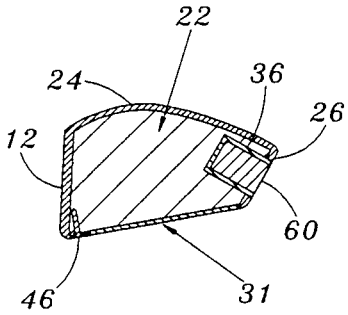
FIG. 5 shows a sectional view of the club in the direction of lines 5—5 of FIG. 2 with the rear weight therein.

The top of the club is formed as a rounded top portion 24 that can be seen clearly as the rounded portion in FIG. 2, as well as in FIGS. 3 and 4. The interior cavity 22 is covered by means of a base plate 30 that fits interiorly of the cup-shaped configuration generally shown as the cup-shaped configuration of the investment casting formed by the face 12, rear wall 26, and top 24.

The investment casting is formed generally for receipt of three cup members, insets, pockets, or receipt indentations 36 at the rear face of the club and a heel cup 38 and toe cup 40. The heel and toe cups 38 and 40 are generally such wherein they provide a two dimensional weighting of the club. They can be filled with brass, lead, or any other weighting material in order to provide the weighting function of this invention. Also, the cups 36, 38 and 40 can be substituted in the alternative with weighted inserts, placed within openings within the investment casting, or attached internally as weights, glued, bonded, welded or formed on the heel, toe and rear portions of the club. When referring to weighting, it is meant an increased density or concentration of weight in the cup areas 36, 38 and 40.

In order to connect the bottom plate 30 to the investment casting side walls, namely the walls which form the portion of the front 12, back 26 and back wall portion wrapping around the sides from the face 12, starting at heel 14 and toe 16, indexing tabs are utilized. The indexing tab at the face can be seen as indexing tab 46. In addition thereto, indexing tabs 48, 50 and 52 are shown. These indexing tabs allow an indexing of the bottom plate 30 into the investment casting to provide a spacing and orientation thereof. Fundamentally, the base plate 30 sits in a little groove which has been established within the lower portion of the investment casting periphery. This can be seen generally as a grooved insert in the form of the groove overlayment 56 of the base plate 30.

The base plate 30 can be of the same material as the investment casting of the head 10 or can be of a brass, bronze, stainless or other material. It can be also either be welded, braised, or inserted by mechanical means and connected to the head 10. Also, such means as epoxy glues and adhesives can be utilized in order to secure the base plate 30 to the side walls of the investment casting 10.

Looking more particularly at the cups 36, 38 and 40 that form and receive the respective rear, heel and toe portion weight areas, it can be seen that a weight 60 has been shown implaced within the cup 36 The weight is also inserted into the other cups 38 and 40. These weights add a concentrated amount of weight at the three given areas of heel, toe and rear of the club.

The cups 36, 38 and 40 are formed as a portion of the investment casting. This can be done by having individual cups with flanges which are received within openings of the side wall of the head 10. The cups 36, 38 and 40 can be provided with a little flange that is inserted against the seat within the head side walls so that it is seated therein and is thereby cast into the head 10 for later receipt of the weights 60 that are fitted therein. Aside from the foregoing weights receiving cups, the weights can be provided in any other form in roughly the same areas, or in a manner to provide three dimensional weighting for increased moment of inertia. The weights can also be formed as enlargements of the club walls, or a thickening such as in the putter head described hereinafter. In all respects, the further the weight is displaced toward the outer wall, the greater the increased moment of inertia and improvement in club performance is encountered.

In essence, an important factor to this invention is to maintain a three dimensional peripheral weighting around the periphery of the club 10. In prior art clubs, it was customary to place the weight at the heel 14 and toe 16. Such weights, such as 38 and 40 can generally be seen and regarded as two dimensional weights for weighting the heel and toe areas to provide stability. This invention obviates the prior art by providing for a three dimensional weighting. It was not seen by those skilled in the prior art that such a weighting would affect a greater or higher moment of inertia. The higher moment of inertia enhances the ability of the club to resist twisting upon impact on an offset basis from the center of gravity of the club.

It is believed that those observing the prior art of two dimensional weighting as being compensatory from preventing club twist, did not appreciate the third weighting in the three dimensional sense of the word. This third weight in cup 36 provided by weight 60 provides for the improved operation of the invention.

The weights can be generally configured in a more uniform manner or concentrated as shown. One way or the other, it should be understood that the weighting must be in a three dimensional mode. This would even extend to a circumferential or curvilinear weighting around the periphery of the club extending from the heel and toe to the back wall 26.

It is important from a physics point of view to maintain a high moment of inertia. As to how the weights are formed to provide this in the three respective areas or on the periphery, one skilled in the art can move the weights in a manner to provide such higher moment of inertia through the three respective areas.

In plain terms, for the moment of inertia to be increased, the weighting can be in several different manners, consistent with the above statements. It is the ability to resist twisting when striking the ball that the increased moment of inertia provides. The greater the club head moment of inertia, the greater the driving distance and the greater the directional control for the golfer.

Fundamentally, if the club head does not strike the ball along a line passing through the club head center of gravity which has been shown in FIGS. 6 through 11 as center of gravity points CG, a slight twisting of the club will be the result. This slight twisting of the club causes the ball to travel down the fairway at an angle away from the intended direction of flight.

This center of gravity line or ideal area in which to strike the ball has been shown in FIGS. 8 through 11 as the center of gravity line 68. The center of gravity line 68 of the club in FIGS. 8 through 11 passes of course through the center of gravity CG. If the ball is hit exactly along the line 68 through the center of gravity CG, it will proceed in a straight line along line 68 away from the club.

Stated another way, the loss of direction or control is proportional to the distance off the club face center of gravity line 68 at which the ball is hit by the club and inversely proportional to the club head moment of inertia. By way of example, for a ball hit off center, doubling the moment of inertia will generally reduce the loss of directional control by a factor of two. Inasmuch as no person can hit the ball every time exactly on the line through the club head center of gravity, namely line 68 passing through CG, the improvement of directional control through an increased club moment of inertia will benefit most golfers.

Figure 6:
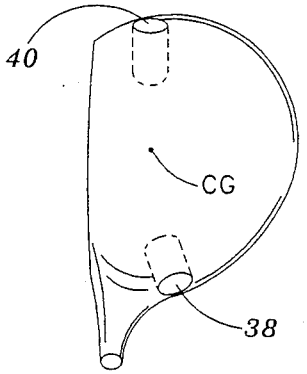
FIG. 6 shows a prior art club with two dimensional weights.
Figure 7:
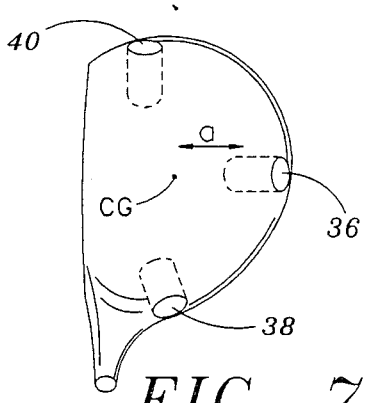
FIG. 7 shows the improved club of this invention with the weights in a three dimensional configuration.

Looking more particularly at FIGS. 6 and 7, it can be seen that the club head has a moment of inertia based upon the weights within the weighted areas 40 and 38. These weighted areas 40 and 38 are such wherein an increased moment of inertia is provided by them. A club with weight 60 in cup 36 will have its moment of inertia increased, compared to a head without weight 60, by approximately the mass of the weight in cup 36 times the distance "a" to the center of gravity squared. This increase in moment of inertia is in addition to the moment of inertia provided by weights in cups 38 and 40.

The addition of the third weight, namely weight 60 in cup 36 increases the moment of inertia up to fifty-six percent over the two weighted club provided by weights in cups 38 and 40. The fact that the third weight in cup 36 is behind the club head center of gravity does not reduce the improvement of the moment of inertia. In fact, the addition of weight in cup 36 will yield increased moment of inertia relevant to reducing the effects of "topping" or "hitting the ball fat", this benefit stemming directly from the three dimensional placement of the weights, an effect not realized by toe-heel only weighting.

Referring to FIG. 6, the prior art, which utilized a toe-heel two dimensional weight distribution, might produce a club with moment of inertia $I_{2D}$. The new, three dimensional weighting art, represented in FIG. 7, will have a moment of inertia $I_{3D}$ which is increased over the prior art. In fact, when the prior art is compared with the new art, one finds approximately that $I_{3D}=I_{2D}+ma^2$, where m is the mass of the added weight 60 in cup 36 and a is the distance from the club head center of gravity to the center of mass of weight 60. Said another way, for a club head of total mass TM, the prior art two dimensional weighting can yield a theoretical maximum moment of inertia of $I_{2D}=3TM H^2/2$ where H is the distance from the center of mass of the toe weight in cup 40 to the center of mass of the heel weight in cup 38 The maximum theoretical moment of inertia for the new, three dimensional design is $I_{3D}=21TM\ H^2/9$, which is 64% greater than the prior art two dimensional weighted club head.

Figure 8:
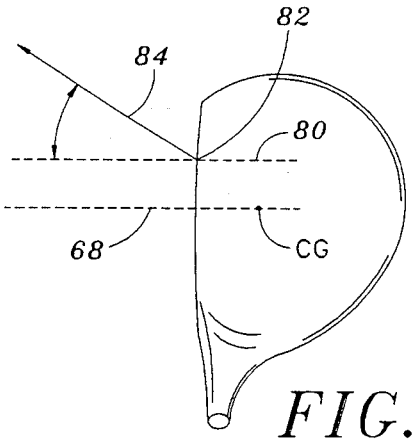
FIG. 8 shows an example of a club striking a ball on the face offset from the center of gravity of a prior art club.

A demonstration of how the club head is improved with different moments of inertia, can be seen in FIGS. 8 through 11. The club head with a greater moment of inertia has greater directional control. This can be seen in the showing of FIG. 8 wherein the intended ball path when hit at the point of impact along line 80 at point 82 of the club face travels along the real path of the ball 84 at an angle shown between lines 80 and line 84. Thus, the intended path of the ball with a low moment of inertia club (i.e. without weights) as seen in FIG. 8, does not take place, but rather it travels along line 84.

With the high moment of inertia club of this invention club as seen with the weights in cups 36, 38, and 40, a substantial improvement takes place. The intended ball path, namely along line 90 is not effectuated when the ball hits the club at point 92. However, the real path of the ball along 94 is not as radically angled as along line 84. In effect, the real path of the ball flight is much closer to the intended path for the high moment of inertia club shown in FIG. 9 wherein the weight 36 has been imposed at the back of the club.

Figure 10:
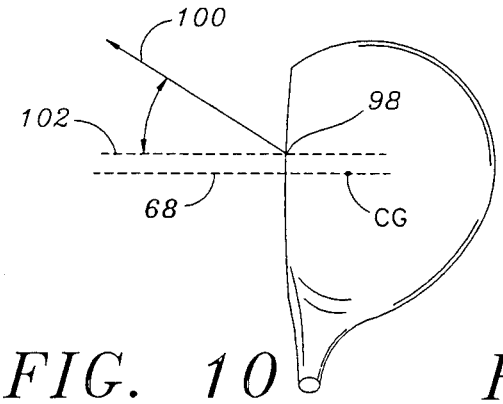
FIG. 10 shows a ball being struck by a prior art club taking flight at a particular angle from the club face.
Figure 11:
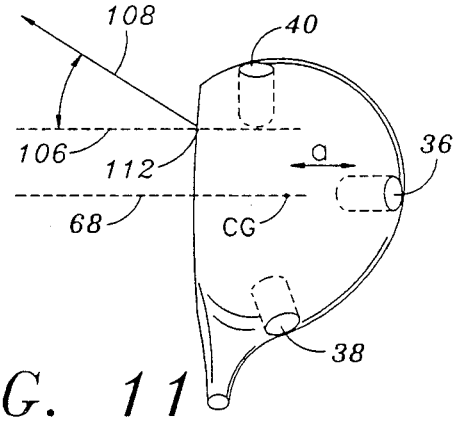
FIG. 11 shows a ball being struck by the club of this invention at a greater point removed from the center of gravity from that shown in FIG. 10, yet the angle of flight is the same.

Another point to note is that one might hit the high moment of inertia club much further off center with the same loss of directional control occurring as for a low moment of inertia club. This is shown in FIGS. 10 and 11. In these showings, a ball hits the club face at point 98 of a low moment of inertia club and travels along line 100 when the intended path of the ball is along line 102. Thus, the low moment of inertia club has a substantial deviation of ball travel along line 100 when hit close to the center of gravity.

To the contrary, the intended ball path 106 as shown in FIG. 11 with the high moment of inertia club provided by weights in cups 36, 38 and 40, is farther off center from the center of gravity line 68. However, the real path of the ball 108 is the same as path 100, even though it is hit much farther off the center of gravity line 68 than the line 102. When hit at point 98 as opposed to the farther distant point 112 on the club head which is removed from the center of gravity, the same angle of flight is encountered.

Figure 9:
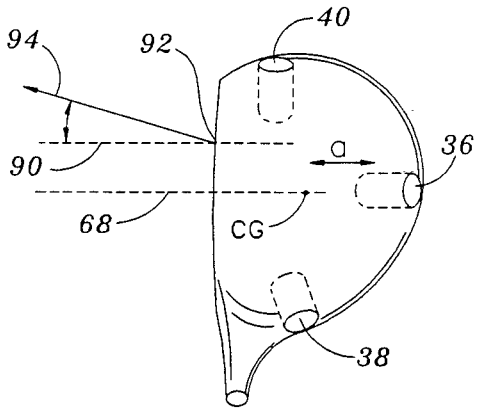
FIG. 9 shows the club of this invention striking the ball on the face of the club at the same offset location from the center of gravity wherein the direction of flight is improved.

The improvement of the toothed rack or curved engaging rack effect may be seen by considering FIGS. 8 and 9. FIG. 8 shows a club with only perimeter weighting, while FIG. 9 shows a club with three dimensional weighting. The center of gravity is moved farther back from the club face in FIG. 9 relative to that in FIG. 8. When a ball strikes point 82 in FIG. 8, the club will rotate about a point behind the center of gravity. The distance from this point of instantaneous rotation to point 82 may be thought of as a radius of a curved toothed rack or gear, with the radius of the golf ball being that of a second curved toothed rack or gear which rotates upon the teeth of the club. As the club rotates during the impact, the ball obtains a spin due to this curved rack turning effect. The spin is in a direction to counter partially any other contributions of the impact which lead to hooking or slicing of the ball, depending whether the ball strikes the club head nearer the heel or toe of the club.

Examination of FIG. 9 shows that the turning effect due to distance of the toothed rack, when three dimensional weighting is used, is increased in the club head. That is to say, the distance from point 92 where the ball contacts the club to the instantaneous center of rotation behind the center of gravity is greater than the distance from point 82 to the corresponding point in FIG. 8. Such increase in toothed rack distance over that in FIG. 8 is caused because the instantaneous center of rotation is farther back from the face in FIG. 9 than 8. This is a direct result of the deeper center of gravity of the three dimensional weighting compared to perimeter weighting. Hence, for a given club angular rotation rate, the larger toothed rack effect of FIG. 9 will enhance the countering effect of the toothed rack induced ball spin and so lead to less hook or slice than that resulting from the club design shown in FIG. 8.

Stated in another way, looking downwardly at FIGS. 8 and 9, it can be seen that the ball has been shown as impacting at point 82 and point 92. The ball would normally be given a degree of impetus to go off in the direction of the respective arrows 84 and 94. Of course, the angle has been lessened in the ball striking the particular inventive club herein in FIG. 9 by comparison to FIG. 8. This is due to the placement of the center of gravity at a further location back from the face of the club. However, the racked gear effect between the club face and the ball being struck in FIGS. 8 and 9, is markedly different. It is believed that when the ball strikes the face in FIG. 8 at point 82, that the curved rack effect between the face of the club and the ball, does not provide the turning of the ball as much as in FIG. 9 where the center of gravity is further removed from the face of the club.

To put the matter in perspective, it should be appreciated that when the ball is hit toward the toe, in other words off center from the center line 68 in either club, that it has a tendency to go in the direction of the arrows shown, namely arrows 84 and 94. It also has a tendency to be spun in a direction which increases this directional movement in the direction of lines 84 and 94. The toothed rack engagement between the club face and the ball tends to overcome this during the moment of impact, while the ball is in contact with the face of the club.

By way of explanation, it should be envisioned that a ball hitting point 82 or point 92 is engaged by the club face during the moment of impact. At this moment, the club tends to move around the center of gravity in a clockwise direction. In doing this, the rack effect of engagement of the ball causes the ball to move in a counter clockwise direction. This counter clockwise direction causes the ball to spin toward the line 68 or axis of the club as it is driven. This spinning toward line 68 compensates in some measure so that it has been found that the ball becomes truer and closer on line due to this counter clockwise spin.

In the alternative, when the ball hits toward the heel of the club on the other side of the center line 68, the club tends to turn on a counter clockwise basis. This turning on a counter clockwise basis turns the ball on the face of it in a clockwise direction, causing the ball from the heel to turn in toward the line of direction of line 68. This thereby also compensates to place the ball on a line closer to the center line by the spin turning it inwardly in a clockwise direction.

Summarily stated, the increased turning moment of the racked toothed effect on the ball by having further center of gravity due to the increased three dimensional weighting, causes the ball when hit off the toe to turn in a counter clockwise direction. When hit off the heel, it causes it to turn in a clockwise direction. Both of these thereby compensate for the classical deviation of the ball from the center line 68 known respectively as a slice or a hook.

Figure 17:
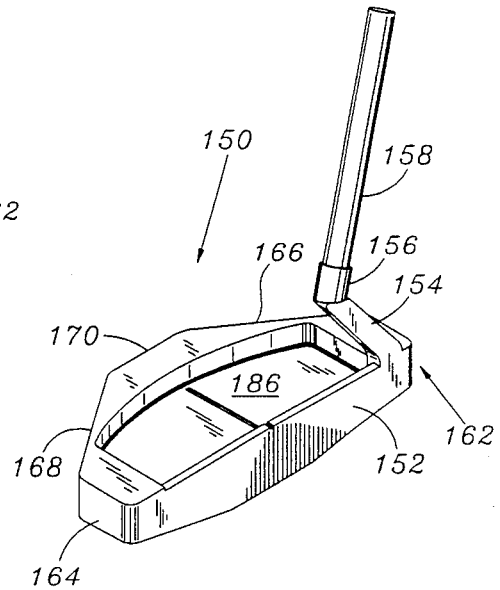
FIG. 17 shows a perspective view of the putter of this invention with a portion of a shaft in the hosel of the club.

Looking more specifically at FIGS. 12 through 17, the concept of having an increased moment of inertia is shown in the form of a putter. The putter is shown in perspective view in FIG. 17. FIG. 17 specifically shows a putter 150 having a face 152 with an angular connecting stem 154 having an upright hosel 156 connected to a shaft shown in dotted configuration, namely shaft 158.

The putter is made by molding a top portion split from the bottom approximately in the direction of lines shown by arrows defining a split line 160 and 162 wherein a parting line is shown. This parting line 160 and 162 is such wherein a cuplike configuration is provided with three spaces on the bottom. It can be seen that the face 152 terminates in a heel 162 and a toe portion 164. The heel and toe portions 162 and 164 taper backwardly in the form of two angular portions 166 and 168 to a rear portion or back face 170.

Figure 12:
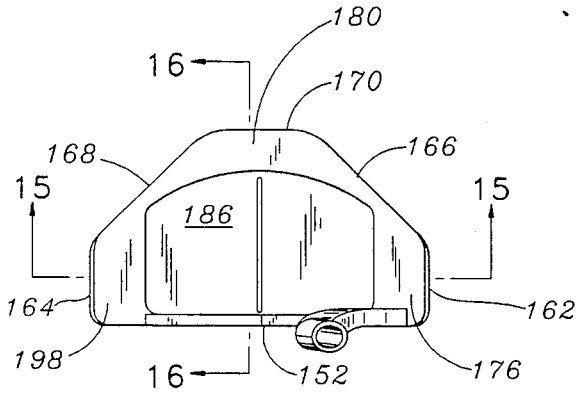
FIG. 12 shows a plan view of a putter utilizing the principles of this invention.

The showing can be more graphically seen in FIG. 12 in the downward plan view thereof. The foregoing peripheral portions of the putter are shown with an enlarged weighting by virtue of an increased moment of inertia through two dimensional weighting at the sides in the form of builtup or weighted portions 176 and 178. The builtup or weighted portions 176 and 178 provide the normal two dimensional increased moment of inertia spoken of in the prior art and are substituted with respect to weights in cups 38 and 40.

In order to provide the increased moment of inertia tantamount to weight 60 in cup 36 of the driver, a weight 180 or builtup portion toward the rear of the face 170 is shown. This builtup or weighted portion 180 increases the overall moment of inertia by having a three dimensional moment of inertia enhancing the entire operation of the club.

The builtup portions 176, 178 and 180 surround a cupped-out area or pocket 186. The cupped-out area or pocket 186 provides for a hollow, pocket or opening area so that the mass or moment of inertia can be increased by the peripheral weighting in the form of the builtup weighted areas 176, 178 and 180.

Figure 16:
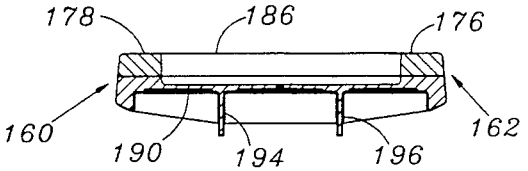
FIG. 16 shows a sectional view in the direction of lines 16—16 of FIG. 12.
Figure 14:
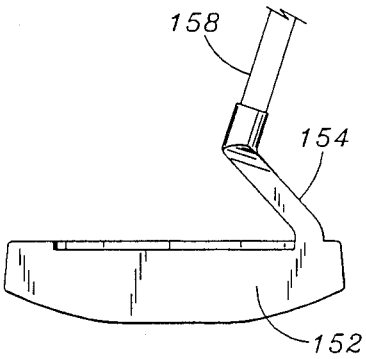
FIG. 14 shows a front view of the putter of this invention.
Figure 15:
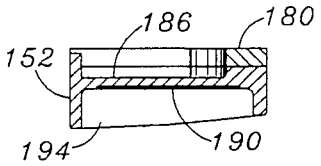
FIG. 15 shows a sectional view in the direction of lines 15—15 of FIG. 12.

The builtup weighting can be generally shown in the cross sectional configuration of FIGS. 15 and 16. In FIG. 15, it can be seen that the builtup areas 178 and 176 are substantial compared to the webbed area, namely webbed area 190 underneath the cupped-out portion or pocket 186. Also, the increased peripheral or moment of inertia weighting provided by the builtup portions 180 can be seen in FIG. 16 more particularly.

The web 190 can be seen in FIG. 16 spanning across the midportion of the club. The web 190 spans the underside of the cup or pocket 186 and is divided by a pair of downwardly extending or transverse webs 194 and 196. Webs 194 and 196 provide for a skid surface as well as a reinforcement to the entire club face 152 and in a manner also to help maintain the rigidity of the club with respect to the overall displaced and increased moment of inertia.

Figure 13:
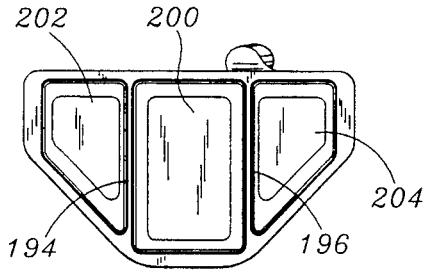
FIG. 13 shows a plan view opposite from that shown in FIG. 12 looking upwardly at the bottom thereof.

Looking more specifically at FIG. 13, it can be seen wherein webs 194 and 196 are seen at the base of the club and provide for a major pocket 200 and two lateral pockets 202 and 204. These lateral pockets 202 and 204 along with pocket 200 are merely such wherein they provide spacing in a manner to facilitate the position of the increased moment of inertia by moving the weighting to the heavier weighted portions 176, 178 and 180. Thus, the lesser combined weight of web pocket areas 200, 202 and 204 serves to lighten this region of the club and at the same time provide for peripheral weighting in the way of a three dimensional weighting to increase the moment of inertia and generally enhance the increased moment of inertia as provided to the driver in FIGS. 1 through 11.

An enhanced feature of this putter is a higher center of gravity. This is due to the fact that the web 190 spanning the outside peripheral areas and the face 152 are such wherein the weights are above the web or center of gravity. By displacing the weighted portions 176, 178 and 180 above the approximate midline area of the web 190, a higher center of gravity is provided. The higher center of gravity creates a certain top spin to the ball by virtue of the way the club generally follows through in making contact with the ball. This enhances the overall effectiveness of the club such that the club is able to strike the ball with increased top spin due to its higher center of gravity over the striking point of the ball.

As a consequence, not only does the three weighted concept of the displaced weights 176, 178 and 180 provide for increased moment of inertia for accuracy as in the driver embodiment, but also a displacement of the center of gravity above the midsectioned area also increases the accuracy due to a provision of top spin on the ball when it is struck.

From the foregoing, it can be seen that this specification as to both the driver and the putter through the increased moment of inertia adds increased accuracy as well as improved golfing through increased top spin through the higher center of gravity of the putter. Consequently, it is believed that this invention is a substantial step over the art and should be read broadly in light of the following claims.

I claim:

1. A golf putter with an increased moment of inertia resulting from three dimensional weighting, comprising:

a club shaft; and a putter head secured to said shaft, comprising:

a head face terminating in a toe portion and a heel portion, the toe and heel portions tapering backwardly in the form of two angular portions to a rear portion;

means for increasing the peripheral weighting of the putter head to increase the club head moment of inertia, comprising heel and toe weighting means at the toe and heel portions for increasing the weighting at these portions, and rear peripheral weighting means for increasing the peripheral weight at said rear portion; and wherein said heel, toe and rear portion weighting means comprises fixed, non-removable means so that the putter head weighting is fixed and not adjustable by the club user, and wherein said heel, toe and rear portion weighting means are provided as built-up portions around a pocket extending between the front face and the respective heel, toe and rear portion weighted areas, and said heel, toe and rear portion weighting means are joined by a web therebetween forming the base of said pocket; and wherein said heel, toe and rear portion weighting means are disposed to position the center of gravity of the putter head above the midpoint of the putter head.

2. The putter of claim 1 wherein said toe, heel and rear portion weighting means are formed form a peripherally enlarged region overlying said web which is bonded to the lower portion of said putter head.

3. A golf putter with an increased moment of inertia, comprising:

a club shaft; and a putter head secured to said shaft, comprising:

a head face for striking the golf ball, the head face terminating at the sides thereof in a toe portion and a heel portion, the toe and heel portions tapering backwardly in the form of tow angular side portions to a rear portion at the rear of the club head;

means for increasing the peripheral weighting of the putter head to increase the club head movement of inertia, characterized by heel and toe weighting means at the toe and heel portions, and rear peripheral weighting means for increasing the peripheral weight at said rear portion, said putter head further comprising a thin web laterally spanning the area between said face, heel, toe and rear portions, and wherein said face, toe heel and rear portions, said angular portions and said web define a first open pocket region extending above said web and between said heel, toe and rear portions, and wherein at least a second pocket is defined below said thin web to further concentrate the putter head mass at said heel, toe and rear portions; and wherein said heel, toe and rear portions weighting means comprises fixed, non-removable means so that the putter head weighting is fixed and not adjustable by the club user.

4. The golf putter of claim 3 wherein said heel, toe and rear portion weighting means are substantially disposed above said web to position the center of gravity of the putter head above the midpoint of the putter head.

5. The golf putter of claim 3 further comprising second and third spaced webs extending below and transverse to said first web and extending between said face and said rear portion to divide said second pocket into a major open pocket region and tow lateral pocket regions, said second and third web providing reinforcement to the club face and increasing the rigidity of the club head while providing the formation of said major and lateral pocket regions which tend to lighten the intermediate club head region and enhance the peripheral weighting to further increase the moment of inertia.

* * * * *